US009964284B2

(12) United States Patent
Clark et al.

(10) Patent No.: US 9,964,284 B2
(45) Date of Patent: May 8, 2018

(54) LIGHT FOR KEYPAD BEZEL

(71) Applicant: Sargent & Greenleaf, Inc., Nicholasville, KY (US)

(72) Inventors: Michael Robert Clark, Lexington, KY (US); George Marshall Horne, Lexington, KY (US); Steven L. Worm, Raleigh, NC (US); Alan C. Billings, Raleigh, NC (US)

(73) Assignee: Sargent & Greenleaf, Inc., Nicholasville, KY (US)

( * ) Notice: Subject to any disclaimer, the term of this patent is extended or adjusted under 35 U.S.C. 154(b) by 231 days.

(21) Appl. No.: 14/575,030

(22) Filed: Dec. 18, 2014

(65) Prior Publication Data

US 2016/0178159 A1 Jun. 23, 2016
US 2017/0284631 A9 Oct. 5, 2017

Related U.S. Application Data

(60) Provisional application No. 61/920,162, filed on Dec. 23, 2013.

(51) Int. Cl.

| | |
|---|---|
| ***F21V 7/04*** | (2006.01) |
| ***F21V 33/00*** | (2006.01) |
| ***F21V 7/00*** | (2006.01) |
| ***F21V 15/00*** | (2015.01) |
| *F21Y 101/00* | (2016.01) |

(52) U.S. Cl.
CPC ..... *F21V 7/00* (2013.01); *F21V 15/00* (2013.01); *F21V 33/00* (2013.01); *F21Y 2101/00* (2013.01)

(58) Field of Classification Search
CPC ..... E05B 17/10; F21V 7/0008; F21V 7/00; F21V 15/00; F21V 33/00
See application file for complete search history.

(56) References Cited

U.S. PATENT DOCUMENTS

| | | | | | |
|---|---|---|---|---|---|
| 1,513,845 | A * | 11/1924 | Michel | F21S 48/1376 | 362/348 |
| 5,057,975 | A * | 10/1991 | Evigan | E05B 17/10 | 362/100 |
| 5,609,051 | A * | 3/1997 | Donaldson | E05B 47/0673 | 340/5.54 |
| 2005/0163310 | A1* | 7/2005 | Lundell | H04M 1/22 | 379/433.07 |
| 2010/0271808 | A1* | 10/2010 | Gammell | E05B 17/10 | 362/100 |

* cited by examiner

*Primary Examiner* — Anh Mai
*Assistant Examiner* — Nathaniel Lee
(74) *Attorney, Agent, or Firm* — Caeden Drayton; Adan Ayala

(57) ABSTRACT

A lock assembly for securing a container having an interior region is provided. In one illustrative embodiment, the lock assembly includes a keypad having a plurality of buttons on a first surface of the keypad, a light-emitting diode, and a bezel surrounding at least a portion of the keypad. The bezel includes a reflective surface positioned to reflect a light from the light-emitting diode, the reflected light illuminating the plurality of buttons.

18 Claims, 7 Drawing Sheets

LIGHT FOR KEYPAD BEZEL

FIELD OF THE INVENTION

The present disclosure relates to access control devices. More particularly, the present disclosure relates to a light to illuminate a keypad of a lock for controlling access to the interior of container, such as a gun safe.

BACKGROUND OF THE INVENTION

Containers, such as gun safes, are used to secure items, such as firearms, in the interior of the container. Locks may be provided on the gun safe to control access to the interior of the container to only authorized users. An illustrative lock includes a keypad for entering a predetermined code to gain access to the interior of the container. The ability to light the buttons on the keypad for a short period of time sufficient to gain access to the interior of the container is desired.

BRIEF DESCRIPTION OF THE DRAWINGS

The above-mentioned and other features and advantages of this disclosure, and the manner of attaining them, will become more apparent and the disclosure itself will be better understood by reference to the following description of embodiments of the invention taken in conjunction with the accompanying drawings, wherein.

Corresponding reference characters indicate corresponding parts throughout the several views. The exemplifications set out herein illustrate exemplary embodiments of the invention and such exemplifications are not to be construed as limiting the scope of the invention in any manner.

DETAILED DESCRIPTION

Figure 1:
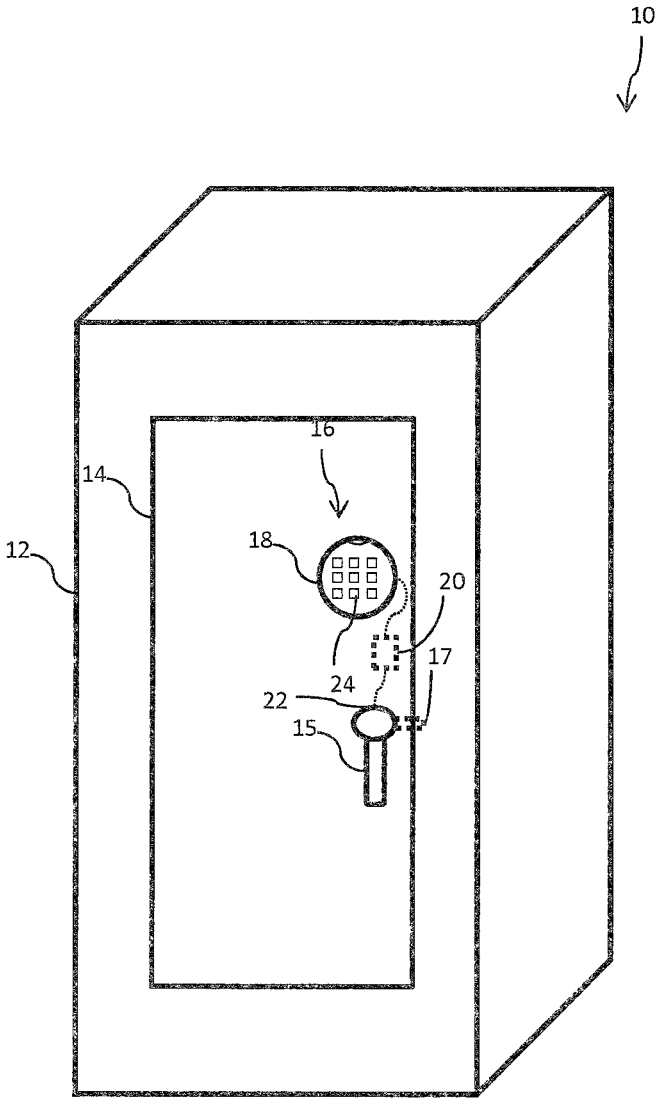
FIG. 1 is a perspective view of an illustrative container, such as a gun safe, and lock including a keypad securing the gun safe.

Referring to FIG. 1, a container 10, such as a gun safe, is shown that includes a body 12, a door 14, and a lock 16. Lock 16 controls access an interior region of container 10. Door 14 includes a handle 15 having a latch or bolt 17 which selectively engages with a recess of body 12 to block the opening of door 14 so that any items in the interior of the container 10, such firearms, are not accessible. Handle 15 is rotatable between a first position, in which the latch engages with the recess of the body 12 and a second position in which the latch is retracted. Lock 16 includes an electronic controller 20 controlling the ability to rotate handle 15.

Lock 16 is mounted on door 14 (as shown in FIG. 1) and illustratively includes a keypad 18 attached to the controller 20. The controller controls rotation of handle 15 by controlling the position of a blocking lever 22 between an extended position and a retracted position. In the extended position, blocking lever 22 prevents the rotation of handle 15 so that handle 15 cannot rotate between the first and second positions. In the retracted position, blocking lever 22 does not prevent the rotation of handle 15, and handle 15 can be rotated from the first to the second position, retracting the bolt 17 and allowing a user to move door 14 between a closed position and an open position. Additional details of suitable locks for use with keypad 18 are provided in U.S. Pat. Nos. 6,016,677; 6,094,952; and 6,212,923, the entire disclosures of which are incorporated by reference herein.

Although container 10 is illustrated as a gun safe, lock 16 may be provided on other containers, such as safes, filing cabinets, and other containers known to those of ordinary skill in the art. Further, although a door 14 is illustrated, lock 16 may be provided to block movement of other devices that close openings, such as sliding drawers or other devices that close openings or block access to interior regions.

As shown in FIG. 1, lock 16 is mounted to door 14 so that bolt 17 horizontally engages a recess in a side of body 12. Lock 16 may be mounted in other orientations so that bolt 17 extends vertically or in any other orientation. Lock 16 may also be mounted in different locations other than those shown. For example, lock 16 may be mounted on the body 12 of container 10 so that bolt 17 engages door 14 in the extended position and does not engage door 14 in the retracted position. Multiple bolts 17 may also be provided.

Lock 16 may be unlocked if a user enters the correct input sequence on the buttons 24 of keypad 18. Controller 20 electronically determines if the user has entered the correct input sequence on the keypad 18. Once controller 20 determines that the correct input sequence has been entered, controller 20 may activate a motor assembly (not shown) to retracts blocking lever 22, or controller 20 may allow the user to retract blocking lever 22 to gain access to the interior of container 10.

Figure 2:
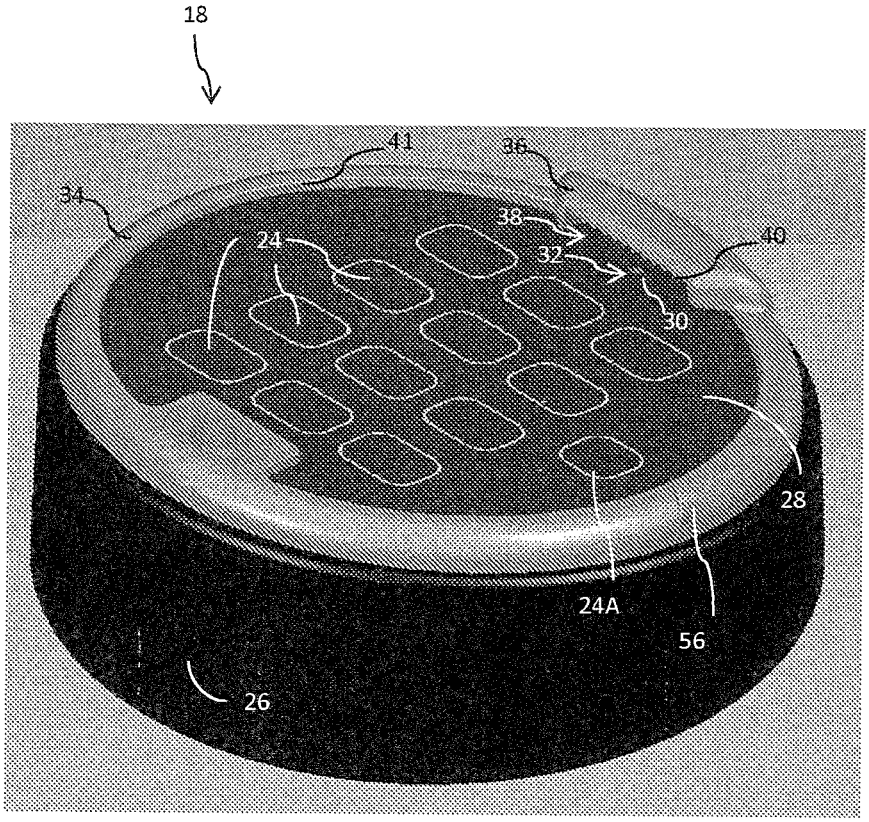
FIG. 2 is an elevated perspective view of a keypad including a light and a bezel with a reflective surface.
Figure 3:
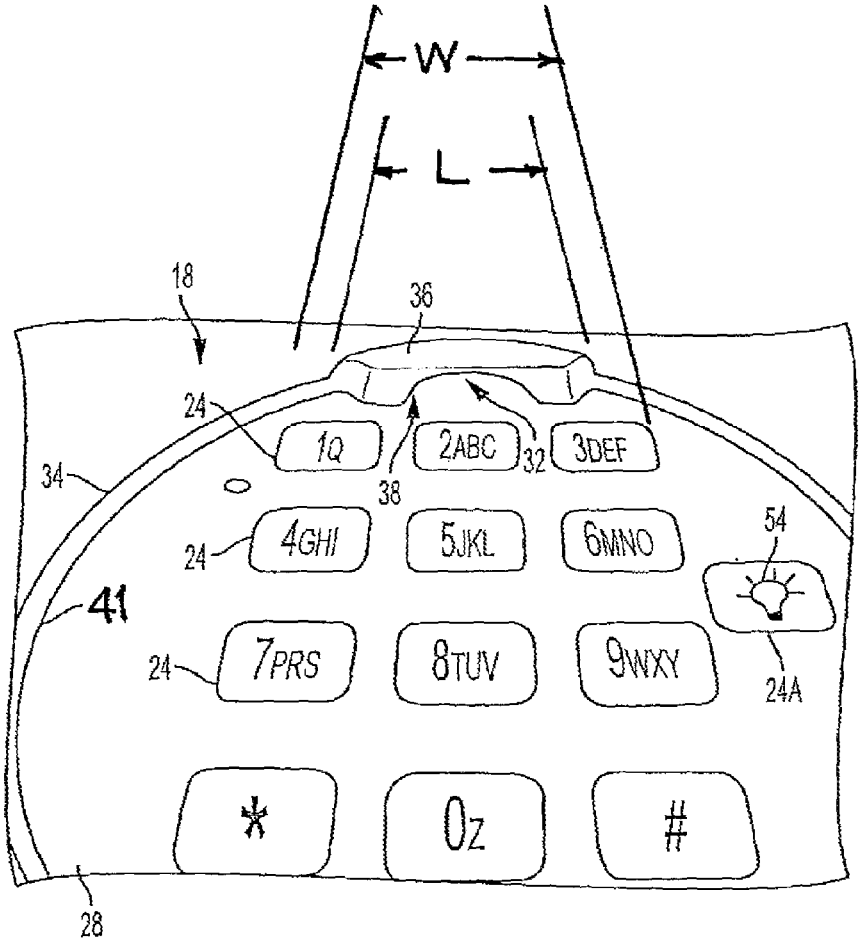
FIG. 3 is a perspective view of a portion of the keypad of FIG. 2.

The keypad 18 is shown in FIGS. 2 and 3. As illustrated, keypad 18 includes a plurality of buttons 24 forming an array, the array having a width "W" (see FIG. 3). As also shown in FIG. 3, at least some of the buttons may correspond to one or more alphabetic or numeric characters. Additional buttons may include non-alphanumeric characters, such as "*", "#", or other symbols.

As shown in FIGS. 2 and 3, keypad 18 includes a housing 26. The plurality of buttons 24 are mounted on a top face 28 of keypad 18. In the illustrated exemplary embodiment, a lower end of the housing 26 is disposed above the top face 28 a greater distance than is an upper end, allowing the top face 28 of keypad 18 to be slightly angled upward towards a user. In another embodiment, the face 28 of keypad 18 is not angled upward.

Figure 4:
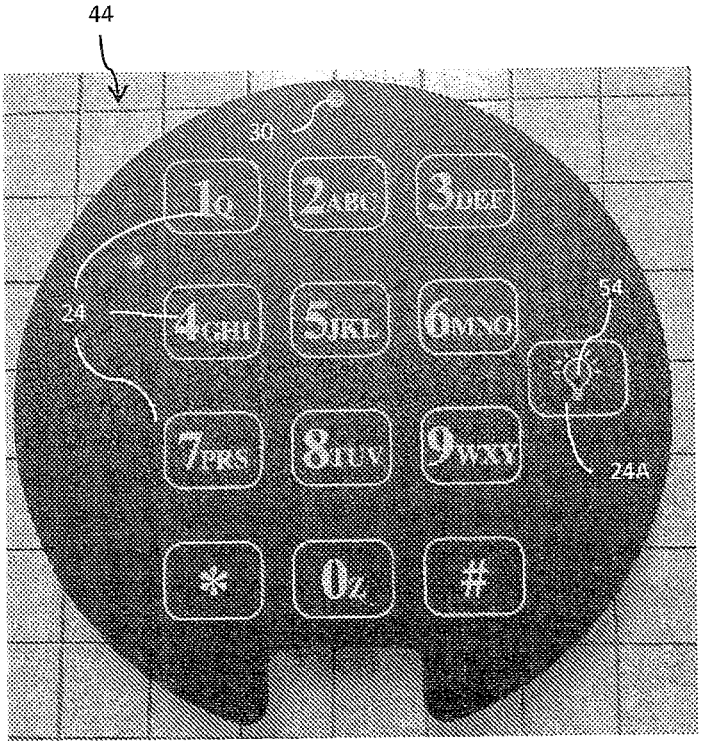
FIG. 4 is a top view of the face of a printed circuit board component of the keypad of FIG. 2.

The exemplary face 28 of keypad 18 of FIGS. 2 and 3 is illustrated in FIG. 4. The face 28 may comprise a keypad printed circuit board (PCB) printed circuit board component 44 of the keypad of FIG. 2 (see FIG. 4).

Referring to FIG. 4, an exemplary PCB component 44 is illustrated. The face 28 of keypad 18, including the plurality of buttons 24, is on a top surface of the PCB component 44. PCB component 44 illustratively includes at least one transparent portion 30 to allow light from at least one light-emitting device, such as a light-emitting diode (LED) 32 to pass through the face 28 of keypad 18 (see FIGS. 2 and 3). Exemplary transparent portions include apertures, windows, clear portions of PCB component 44, and combinations thereof. In one embodiment, the transparent portion 30 includes an aperture in a first layer (not shown) of PCB component 44 and a clear window in a second layer (not shown) of PCB component 44 positioned on top of the first layer.

At least one light element, such as an LED 32, is mounted to a back side (not shown) of PCB component 44, such that light from LED 32 is transmitted through transparent portion 30 in PCB component 44. By mounting LED 32 on a back side of PCB component 44, the LED 32 is hidden from direct view of a user and is mounted in an area protected from physical damage. In addition, LED 32 is mounted in an area protected from electrostatic discharge (ESD) events. ESD events are known to occur when an operator approaches the container 10 across a carpeted floor. However, by positioning LED 32 behind PCB component 44, LED 32 and circuitry supporting LED 32 are protected from direct ESD strikes. Bezel 34 may be made of an electrically conductive material, such as metal, that receives or grounds the ESD to divert the ESD away from LED 32 and circuitry 58 supporting LED 32. Additionally, bezel 34 may be made of electrically insulating materials, such as plastic materials.

Referring again to FIGS. 2 and 3, keypad 18 further includes a bezel 34 surrounding the face 28 of keypad 18. Bezel 34, as shown in FIG. 3, includes a protruding portion 36 extending outward from face 28 of keypad 18, and having a circumferential length "L" extending circumferentially a fraction of the circumference of the bezel. In one embodiment, the circumferential length "L" may be less than the width "W" of the array of buttons 24 on the keypad 18. A gap 38 is formed under protruding portion 36 between bezel 34 and face 28. As illustrated, gap 38 formed under the protruding portion 36 is aligned with transparent portion 30 of PCB component 44 and LED 32. In the illustrated embodiment, LED 32 is hidden from the view of a user by protruding portion 36 of bezel 34.

A bottom side of protruding portion 36 includes reflective surface 40. Light is transmitted from LED 32 through transparent portion 30 and is reflected off of reflective surface 40. In one embodiment, reflective surface 40 is a concave portion of the protruding portion 36 of the bezel 34, wherein reflective surface 40 directs reflected light from LED 32 to illuminate the plurality of buttons 24 on face 28.

At least a portion of bezel 34 may have a reflective finish. In one embodiment, the entire surface of bezel 34 includes a reflective finish. In another embodiment, only a portion of the surface of bezel 34, such as reflective surface 40 and interior circumference 41, includes a reflective finish. Suitable reflective finishes include chrome plating.

Figure 5:
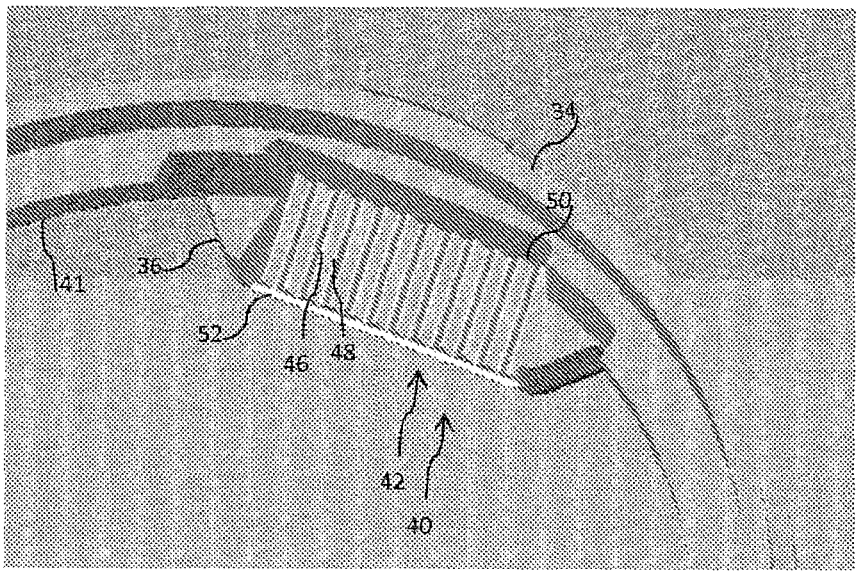
FIG. 5 is a back view of a portion of a bezel having a corrugated reflective surface.

Referring to FIG. 5, in another embodiment, reflective surface 40 is a corrugated surface 42 of bezel 34, positioned on the bottom side of protruding portion 36, and consequently having a circumferential length not greater than the circumferential length "L" of the protruding portion. Corrugated surface 42 includes a plurality of substantially parallel ridges 46 and furrows 48 forming a reflective surface that directs diffused reflected light from LED 32 to illuminate the plurality of buttons 24 on face 28. Corrugated surface 42 reflects light from LED 32 in a diffuse manner rather than a direction manner. The diffuse reflection from corrugated surface 42 provides a more even lighting of the plurality of buttons 24 on face 28.

As shown in FIG. 5, a first end 50 of reflective surface 40 may be positioned closer to face 28 than a second end 52 of reflective surface 40. In the exemplary embodiment illustrated in FIG. 5, first end 50 is positioned closer to the outer circumference of bezel 34 than the second end 52. This positioning creates an angle between reflective surface 40 and face 28, allowing for a more even lighting of the plurality of buttons 24 on face 28.

Referring again to the exemplary embodiment illustrated in FIGS. 2 and 3, at least one of the plurality of buttons 24 may correspond to a light button 24A. Pressing light button 24A causes controller 20 to turn on LED 32, illuminating the plurality of buttons 24 on face 28 of keypad 18. In one embodiment, controller 20 includes a timer and turns off LED 32 after a predetermined period of time. The predetermined period of time is illustratively a brief time sufficient to enter the correct input sequence on keypad 18. According to alternative embodiments of the present disclosure, light button 24A is replaced or supplemented with a motion and/or proximity sensor that detects the presence of a person. Upon detection of movement and/or a physical property indicating the presence of a person, the motion and/or proximity sensor sends an indication to controller 20 that then turns on LED 32, illuminating the plurality of buttons 24.

Keypad 18 may further include at least one orientation feature to allow an operator to find the light button 24A in the dark. In one embodiment, light button 24A includes one or more raised features, such as nodule 54 (See FIGS. 3 and 4). In another embodiment, bezel 34 includes an indicator, such as guide 56, indicating the side of bezel 34 closest to light button 24A (See FIG. 2).

Figure 6:
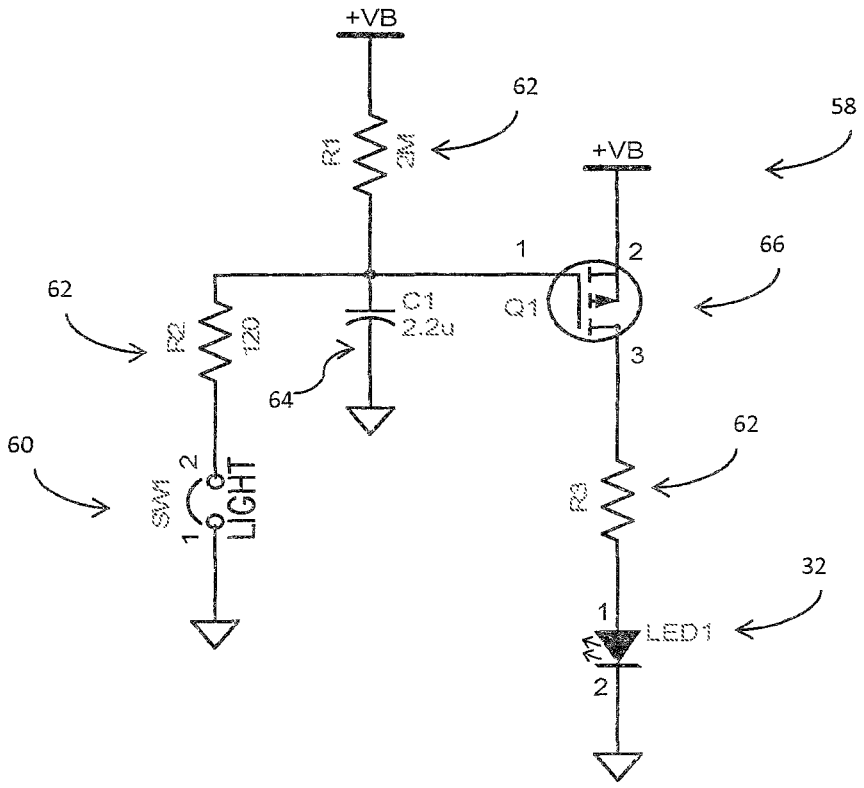
FIG. 6 is a schematic view of electrical circuitry provided to support a light-emitting diode.

As shown in FIG. 6, circuitry 58 includes a switch 60 operated by button 24A, a plurality of resistors 62, a capacitor 64, and a transistor 66. By shielding LED 32 from ESD, the components of circuitry 58 are also protected from the ESD, particularly transistor 66, which is more susceptible to damage from ESD. The timing of how long LED 32 remains lit after button 24A is pressed by a user is controlled by the respective resistance and capacitance of R1 resistor 62 and capacitor 64.

Figure 7:
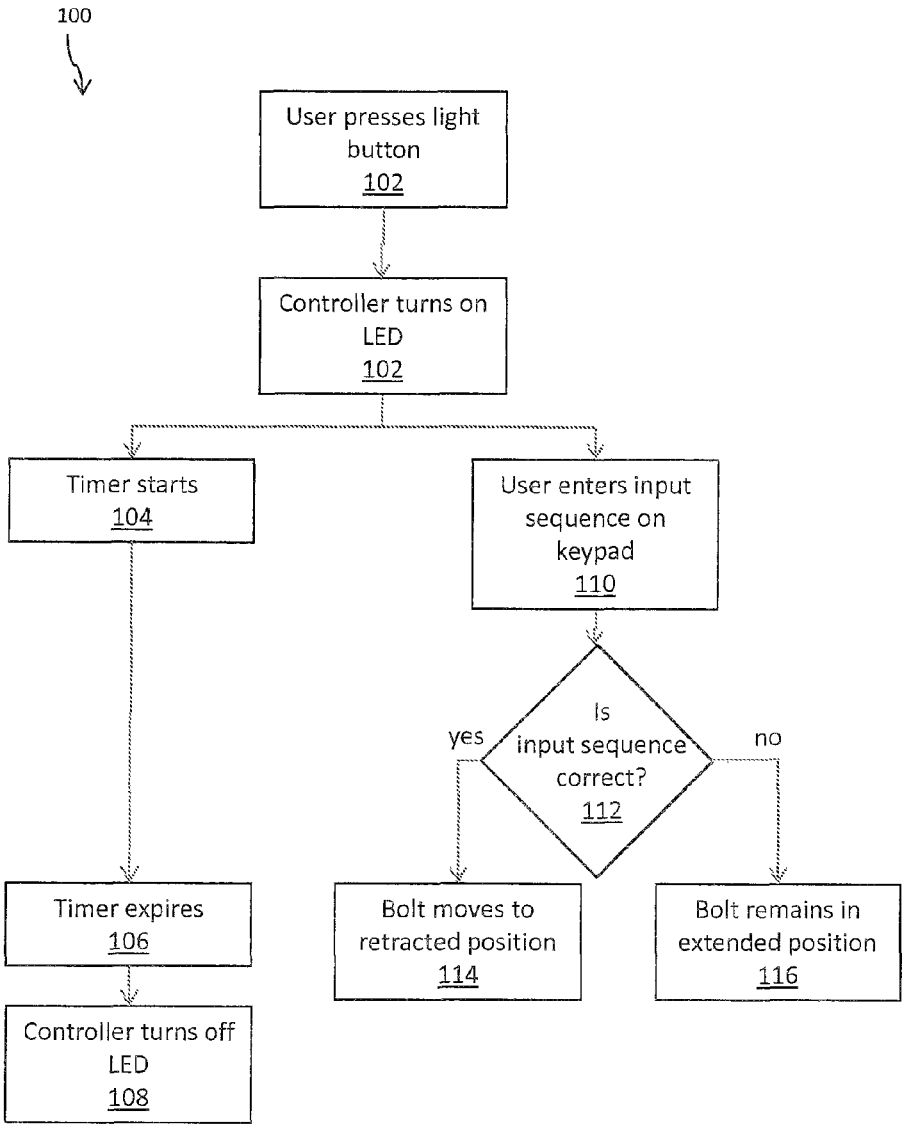
FIG. 7 illustrates an exemplary method of opening a container including an illuminated keypad.

Referring next to FIG. 7, an exemplary method 100 of opening container 10 is illustrated. In step 102, a user presses light button 24A. In response, in step 102, controller 20 turns on LED 32, illuminating the plurality of buttons 24 of keypad 18. In step 104, a timer is started. After a predetermined time, in step 106 the timer expires and the controller 20 turns off LED 32 in step 108. While the LED illuminates the keypad 18, the user enters an input sequence using the plurality of buttons 24 on the keypad 18. In step 112, the controller 20 determines whether the user has entered the correct input sequence. If the controller determines that the correct input sequence was entered, in step 114 the controller activates a motor assembly to retract blocking lever 22, allowing the user to gain access to the interior of container 10. If the controller determines that the correct input sequence was not entered, in step 116 the blocking lever 22 remains in the extended position, which blocks the opening of door 14 and prevents access to the interior of the container 10.

While this invention has been described as having preferred designs, the present invention can be further modified within the spirit and scope of this disclosure. This application is therefore intended to cover any variations, uses, or adaptations of the disclosure using its general principles.

What is claimed is:

1. A lock assembly for securing a container having an interior region, the lock assembly including:

a keypad having a plurality of buttons on a first surface of the keypad;

a light-emitting device positioned on a second surface of the keypad, the first surface being opposite the second surface and including a transparent portion, the light from the light-emitting device being transmitted through the transparent portion;

a bezel surrounding the keypad and having a circumference, and further including a protruding portion having a circumferential length which is a fraction of the circumference of the bezel, the protruding portion extending outward from the keypad and further including a bottom side, the protruding portion and the keypad defining a gap aligned with the transparent portion; and a reflective surface positioned on the bottom side of the protruding portion and having a circumferential length not greater than the circumferential length of the protruding portion;

wherein the light-emitting device is positioned behind the protruding portion; and wherein the light-emitting device, transparent portion, protruding portion and reflective surface are configured to cooperate to reflect light from the light-emitting device to illuminate the plurality of buttons.

2. The lock assembly of claim 1, further including a light button, the light-emitting device being configured to emit the light when the light button is activated.

3. The lock assembly of claim 2, wherein the light-emitting device is configured to stop emitting the light after a predetermined time period.

4. The lock assembly of claim 2, wherein:

the keypad includes an orientation feature to allow an operator to find the light button in the dark; and wherein the orientation feature includes one or more raised features formed on the light button.

5. The lock assembly of claim 1, wherein the reflective surface includes a corrugated surface.

6. The lock assembly of claim 1, wherein the light-emitting device is protected from an electrostatic discharge event on the keypad.

7. The lock assembly of claim 1, wherein the lock assembly is configured to allow access to the interior region of the container upon receiving a predetermined input sequence from the plurality of buttons.

8. The lock assembly of claim 1, wherein the circumferential length of the protruding portion is less than half the circumference of the bezel.

9. The lock assembly of claim 8, wherein the buttons on the keypad form an array having a width, and the circumferential length of the protruding portion is less than the width of the array.

10. The lock assembly of claim 1, wherein:

the keypad includes a housing and a top face;

the housing has a lower end and an upper end;

the lower end is disposed above the top face a greater distance than is the upper end; and wherein the keypad is angled upward towards a user.

11. A lock assembly for securing a container having an interior region, the lock assembly including:

a keypad having a top face and a plurality of buttons mounted on the top face;

a light-emitting device; and a bezel surrounding at least a portion of the keypad and having an outer circumference;

wherein the bezel includes a protruding portion having a circumferential length less than the outer circumference of the bezel, the protruding portion extending outward from the keypad and further including a bottom side and a reflective corrugated surface positioned on the bottom side to reflect light from the light-emitting device, the light reflected from the corrugated surface illuminating the plurality of buttons;

the corrugated surface includes a first end and a second end;

the first end is positioned closer to the top face than is the second end;

the first end is positioned closer to the outer circumference of the bezel than is the second end; and wherein an angle is created between the reflective surface and the top face, creating a more even lighting of the plurality of buttons on the top face.

12. The lock assembly of claim 11, wherein the corrugated surface includes a plurality of substantially parallel ridges and furrows.

13. The lock assembly of claim 11, further comprising a gap defined between the protruding portion and the keypad, the light emitting device being positioned below the gap, and the corrugated surface being positioned above the gap.

14. The lock assembly of claim 11, wherein the corrugated surface is chrome-plated.

15. The lock assembly of claim 11, wherein the plurality of buttons are positioned on a first surface of the keypad and the light-emitting device is positioned on a second surface of the keypad, the first surface being opposite the second surface.

16. The lock assembly of claim 11, wherein the lock assembly is configured to allow access to the interior region of the container upon receiving a predetermined input sequence from the plurality of buttons.

17. A lock assembly for securing a container having an interior region, the lock assembly including:

a keypad having a plurality of buttons on a first surface of the keypad;

a light-emitting device;

circuitry supporting the light-emitting device, and a bezel formed of electrically-conductive material;

wherein the bezel receives or grounds electrostatic discharges (ESD) to divert the ESD away from the light-emitting device and the circuitry supporting the light-emitting device; and wherein the bezel further shields the light emitting device and the circuitry supporting the light-emitting device from direct ESD strikes.

18. A lock assembly for securing a container having an interior region, the lock assembly including:

a keypad having a plurality of buttons on a first surface of the keypad;

a L.E.D. positioned on a second surface of the keypad, the first surface being opposite the second surface and including a transparent portion, the light from the L.E.D. being transmitted through the transparent portion;

a bezel surrounding at least a portion of the keypad and having a circumference, and further including a protruding portion having a circumferential length which is less than the circumference of the bezel, the protruding portion extending outward from the keypad and further including a bottom side, the protruding portion and the keypad defining a gap aligned with the transparent portion; and a reflective surface positioned on the bottom side of the protruding portion and having a circumferential length not greater than the circumferential length of the protruding portion;

wherein the L.E.D. is positioned behind the protruding portion; and wherein the L.E.D., transparent portion, protruding portion and reflective surface are configured to cooperate to reflect light from the light-emitting device to illuminate the plurality of buttons without requiring either that the keypad include an ultraviolet light reactive portion, or that the L.E.D. be an ultraviolet light source.

* * * * *